US008646218B1

(12) United States Patent
Iannelli

(10) Patent No.: US 8,646,218 B1
(45) Date of Patent: Feb. 11, 2014

(54) ROOF GUTTER COVER WITH VARIABLE APERTURE SIZE

(76) Inventor: Anthony M. Iannelli, Cincinnati, OH (US)

( * ) Notice: Subject to any disclaimer, the term of this patent is extended or adjusted under 35 U.S.C. 154(b) by 9 days.

(21) Appl. No.: 13/557,408

(22) Filed: Jul. 25, 2012

(51) Int. Cl.
*E04D 13/00* (2006.01)

(52) U.S. Cl.
USPC ..... 52/12; 52/11; 210/162; 210/170.03

(58) Field of Classification Search
USPC ..... 52/11, 12; 210/162, 170.03, 474
See application file for complete search history.

(56) References Cited

U.S. PATENT DOCUMENTS

| | | | | |
|---|---|---|---|---|
| 397,534 | A | 2/1889 | Carroll | |
| 546,042 | A | 9/1895 | Van Horn | |
| 603,611 | A | 5/1898 | Nye | |
| 836,012 | A | 11/1906 | Cassen | |
| 870,165 | A | 11/1907 | Hagler et al. | |
| 891,405 | A | 6/1908 | Cassens | |
| 1,101,047 | A | 6/1914 | Yates | |
| 1,602,261 | A | 10/1926 | Hill | |
| 2,144,663 | A | 1/1939 | Petersen | |
| 2,175,138 | A * | 10/1939 | Westlake, Jr. | 52/12 |
| 2,219,953 | A * | 10/1940 | Fry | 52/12 |
| 2,247,024 | A | 6/1941 | Hurley | |
| 2,271,081 | A | 1/1942 | Layton | |
| 2,334,779 | A | 11/1943 | Luff | |
| 2,348,827 | A | 5/1944 | Lambert | |
| 2,431,012 | A | 11/1947 | Alig | |
| 2,537,243 | A | 1/1951 | Swartz | |
| 2,569,568 | A | 10/1951 | Lipshaw | |
| 2,636,458 | A | 4/1953 | Harris | |
| 2,669,950 | A | 2/1954 | Bartholomew | |
| 2,672,832 | A | 3/1954 | Goetz | |
| D181,753 | S | 12/1957 | Scanland et al. | |
| 2,847,949 | A | 8/1958 | Pond | |
| 2,873,700 | A | 2/1959 | Heier | |
| 2,935,954 | A * | 5/1960 | Matthews et al. | 210/474 |
| 2,988,226 | A | 6/1961 | Campbell | |

(Continued)

FOREIGN PATENT DOCUMENTS

| | | |
|---|---|---|
| AT | 327 651 | 4/1975 |
| AT | 77270 | 7/1992 |

(Continued)

OTHER PUBLICATIONS

Extended Search Report and Supplementary European Search Report dated Oct. 5, 2010 for Application No. EP 06748529.
International Search Report dated Oct. 2, 2006 for Application No. PCT/US06/10288.
Written Opinion dated Oct. 2, 2006 for Application No. PCT/US06/010288.

(Continued)

*Primary Examiner* — Robert Canfield
*Assistant Examiner* — Charissa Ahmad
(74) *Attorney, Agent, or Firm* — Frost Brown Todd LLC

(57) ABSTRACT

A gutter cover for a roof gutter, fashioned to extend longitudinally in overlying relation to a length of the gutter. The gutter cover comprises: (i) a top portion extending forwardly from a rear edge of the gutter cover; (ii) a front wall extending downwardly from the top portion; (iii) a ledge extending generally horizontally in front of the front wall; (iv) a first longitudinally extending ridge formed in the top portion, (v) a first bank of apertures behind the first longitudinally extending ridge, and (vi) a second bank of apertures in front of the first longitudinally extending ridge; wherein the average size of the apertures in the first bank is larger than the average size of the apertures in the second bank.

11 Claims, 3 Drawing Sheets

(56) References Cited

U.S. PATENT DOCUMENTS

| | | | | | |
|---|---|---|---|---|---|
| 3,256,650 | A | | 6/1966 | Weckerly et al. | |
| 3,296,749 | A | | 1/1967 | Cotter | |
| 3,297,285 | A | * | 1/1967 | Simmons | 248/48.1 |
| 3,388,555 | A | | 6/1968 | Foster | |
| 3,420,378 | A | | 1/1969 | Turner | |
| 3,426,987 | A | | 2/1969 | Leslie | |
| 3,507,396 | A | | 4/1970 | Homa | |
| 109,067 | A | | 11/1970 | Smith, Jr. | |
| 3,612,453 | A | | 10/1971 | Zimmer | |
| 3,660,955 | A | | 5/1972 | Simon | |
| 3,710,405 | A | | 1/1973 | Watts | |
| 3,752,428 | A | | 8/1973 | Trostle et al. | |
| 3,793,793 | A | * | 2/1974 | Dobbins | 52/220.3 |
| 3,812,636 | A | * | 5/1974 | Albrecht et al. | 52/334 |
| 3,892,378 | A | | 7/1975 | Lane | |
| 3,950,951 | A | | 4/1976 | Zukauskas | |
| 4,032,456 | A | * | 6/1977 | Berce | 210/474 |
| 4,036,761 | A | * | 7/1977 | Rankin | 210/474 |
| 4,178,469 | A | * | 12/1979 | Fork | 174/489 |
| 4,198,043 | A | | 4/1980 | Timbes et al. | |
| 4,241,548 | A | | 12/1980 | Rowe | |
| 4,254,595 | A | | 3/1981 | Crosslen | |
| 4,307,976 | A | | 12/1981 | Butler | |
| 4,395,852 | A | * | 8/1983 | Tang | 52/12 |
| 4,404,775 | A | | 9/1983 | Demartini | |
| 4,411,110 | A | | 10/1983 | Carey | |
| 4,435,925 | A | | 3/1984 | Jefferys | |
| 4,455,791 | A | | 6/1984 | Elko et al. | |
| 4,467,579 | A | | 8/1984 | Weiner | |
| 4,497,146 | A | | 2/1985 | Demartini | |
| 4,586,298 | A | * | 5/1986 | Colp | 52/12 |
| 4,604,837 | A | * | 8/1986 | Beam | 52/12 |
| 4,622,785 | A | | 11/1986 | Miller | |
| 4,726,159 | A | * | 2/1988 | Stohs | 52/99 |
| 4,750,300 | A | | 6/1988 | Winger, Jr. | |
| 4,796,390 | A | | 1/1989 | Demartini | |
| 4,848,044 | A | | 7/1989 | LaRoche et al. | |
| 4,888,920 | A | * | 12/1989 | Marulic | 52/12 |
| 4,937,986 | A | | 7/1990 | Way, Sr. et al. | |
| 4,941,299 | A | | 7/1990 | Sweers | |
| 4,944,050 | A | | 7/1990 | Shames et al. | |
| D310,259 | S | | 8/1990 | Hitchens | |
| 4,949,514 | A | | 8/1990 | Weller | |
| 5,010,696 | A | | 4/1991 | Knittel | |
| 5,029,794 | A | | 7/1991 | Wolfe | |
| 5,072,551 | A | | 12/1991 | Manoogian, Jr. | |
| 5,099,620 | A | | 3/1992 | Carey | |
| 5,106,046 | A | | 4/1992 | Rowles et al. | |
| 5,181,350 | A | | 1/1993 | Meckstroth | |
| 5,216,852 | A | | 6/1993 | Bemis et al. | |
| 5,271,191 | A | | 12/1993 | Vahamaki | |
| 5,271,192 | A | | 12/1993 | Nothum, Sr. et al. | |
| 5,339,575 | A | | 8/1994 | Kuhns | |
| 5,375,379 | A | | 12/1994 | Meckstroth | |
| 5,406,755 | A | | 4/1995 | Serano | |
| 5,457,916 | A | | 10/1995 | Tenute | |
| 5,536,113 | A | | 7/1996 | McGregor | |
| 5,555,680 | A | | 9/1996 | Sweers | |
| 5,557,891 | A | | 9/1996 | Albracht | |
| 5,588,261 | A | | 12/1996 | MacConochie | |
| 5,605,020 | A | | 2/1997 | Chambers | |
| 5,640,809 | A | | 6/1997 | Iannelli | |
| 5,640,810 | A | | 6/1997 | Pietersen | |
| 5,660,001 | A | | 8/1997 | Albracht | |
| 5,729,931 | A | | 3/1998 | Wade | |
| 5,737,879 | A | | 4/1998 | Sweet | |
| 5,802,777 | A | | 9/1998 | Sato et al. | |
| 5,813,173 | A | | 9/1998 | Way, Sr. | |
| 5,852,990 | A | | 12/1998 | Primdahl | |
| 5,862,631 | A | | 1/1999 | Attaway et al. | |
| 5,893,240 | A | | 4/1999 | Ealer, Sr. | |
| 5,911,659 | A | | 6/1999 | Serano | |
| 5,956,904 | A | | 9/1999 | Gentry | |
| 5,960,591 | A | | 10/1999 | Schluter | |
| 6,009,672 | A | | 1/2000 | Kuhns | |
| 6,016,631 | A | | 1/2000 | Lowrie, III | |
| 6,047,502 | A | | 4/2000 | Kimmitt et al. | |
| 6,067,755 | A | | 5/2000 | Maanum | |
| 6,073,398 | A | | 6/2000 | Williams | |
| 6,098,344 | A | | 8/2000 | Albracht | |
| 6,098,345 | A | | 8/2000 | Demartini et al. | |
| 6,134,843 | A | | 10/2000 | Tregear | |
| 6,161,338 | A | | 12/2000 | Kuhns | |
| 6,164,020 | A | | 12/2000 | Nitch | |
| 6,202,357 | B1 | | 3/2001 | Spradlin | |
| 6,254,039 | B1 | | 7/2001 | Zimmerman | |
| 6,269,592 | B1 | | 8/2001 | Rutter | |
| 6,314,685 | B1 | | 11/2001 | Sullivan | |
| 6,349,506 | B1 | | 2/2002 | Pace et al. | |
| 6,363,662 | B1 | | 4/2002 | Coates | |
| 6,367,743 | B1 | | 4/2002 | Iannelli | |
| 6,412,228 | B1 | | 7/2002 | Meckstroth | |
| 6,412,229 | B2 | | 7/2002 | Kuhns | |
| 6,427,388 | B1 | | 8/2002 | Brochu | |
| 6,453,622 | B1 | | 9/2002 | Walters | |
| 6,463,700 | B2 | | 10/2002 | Davis | |
| 6,493,993 | B1 | | 12/2002 | Serano | |
| 6,598,352 | B2 | | 7/2003 | Higginbotham | |
| 6,681,527 | B2 | | 1/2004 | Baker | |
| 6,688,045 | B1 | | 2/2004 | Pilcher | |
| 6,701,674 | B1 | | 3/2004 | Albracht | |
| 6,732,477 | B1 | | 5/2004 | Richard | |
| 6,735,907 | B2 | | 5/2004 | Stevens | |
| 6,736,570 | B2 | | 5/2004 | Garza | |
| 6,745,516 | B2 | * | 6/2004 | Beyers | 52/12 |
| 6,854,692 | B1 | | 2/2005 | Winkel | |
| 6,877,281 | B1 | | 4/2005 | Gavin | |
| 6,904,718 | B2 | | 6/2005 | Fox | |
| 6,968,651 | B2 | | 11/2005 | Bergeron | |
| 7,143,549 | B2 | | 12/2006 | Brochu | |
| 7,191,564 | B2 | * | 3/2007 | Higginbotham | 52/12 |
| 7,581,355 | B2 | | 9/2009 | Smith | |
| 7,581,356 | B1 | * | 9/2009 | Balkum et al. | 52/12 |
| 7,650,720 | B2 | * | 1/2010 | Ealer, Sr. | 52/12 |
| 7,658,036 | B2 | | 2/2010 | Banks et al. | |
| 7,836,637 | B2 | | 11/2010 | Iannelli | |
| 7,950,187 | B2 | | 5/2011 | Iannelli | |
| 8,250,813 | B2 | * | 8/2012 | Robins | 52/12 |
| 8,397,435 | B2 | * | 3/2013 | Iannelli | 52/11 |
| 8,578,658 | B2 | * | 11/2013 | Snell | 52/12 |
| 2002/0124476 | A1 | | 9/2002 | Iannelli | |
| 2003/0110712 | A1 | | 6/2003 | Brochu | |
| 2004/0244302 | A1 | * | 12/2004 | Neumann | 52/11 |
| 2004/0250478 | A1 | * | 12/2004 | McDonald et al. | 52/11 |
| 2005/0005526 | A1 | | 1/2005 | Teed | |
| 2005/0172566 | A1 | * | 8/2005 | McDonald et al. | 52/12 |
| 2005/0183343 | A1 | * | 8/2005 | Jones | 52/11 |
| 2005/0210758 | A1 | | 9/2005 | Iannelli | |
| 2005/0235577 | A1 | | 10/2005 | Smith | |
| 2005/0257432 | A1 | * | 11/2005 | Higginbotham | 52/12 |
| 2006/0179723 | A1 | | 8/2006 | Robins | |
| 2006/0196124 | A1 | * | 9/2006 | Bachman | 52/12 |
| 2007/0012845 | A1 | | 1/2007 | Iannelli | |
| 2007/0199249 | A1 | * | 8/2007 | Beck et al. | 52/12 |
| 2007/0214730 | A1 | * | 9/2007 | Cota | 52/12 |
| 2007/0234647 | A1 | * | 10/2007 | Higginbotham | 52/12 |
| 2008/0029654 | A1 | | 2/2008 | Iannelli | |
| 2008/0127575 | A1 | * | 6/2008 | Ealer | 52/12 |
| 2008/0190040 | A1 | * | 8/2008 | Graves | 52/12 |
| 2009/0031638 | A1 | * | 2/2009 | Iannelli | 52/12 |
| 2009/0139180 | A1 | | 6/2009 | Kehs et al. | |
| 2009/0188173 | A1 | * | 7/2009 | Ealer, Sr. | 52/12 |
| 2011/0138697 | A1 | * | 6/2011 | Martin | 52/12 |
| 2011/0185641 | A1 | * | 8/2011 | Snell | 52/12 |
| 2011/0225898 | A1 | | 9/2011 | Iannelli | |
| 2011/0265391 | A1 | * | 11/2011 | Robins | 52/12 |
| 2012/0247032 | A1 | * | 10/2012 | Lowrie, III | 52/12 |
| 2013/0284650 | A1 | * | 10/2013 | Higginbotham | 210/162 |

FOREIGN PATENT DOCUMENTS

| | | | | |
|---|---|---|---|---|
| CA | 2 172 948 | | 9/1996 | |
| CA | 2 646 519 | | 9/2007 | |
| DE | 3905961 | A1 * | 9/1989 | E04D 13/06 |

(56) References Cited

FOREIGN PATENT DOCUMENTS

| | | | | | |
|---|---|---|---|---|---|
| DE | 3931020 | A1 * | 5/1990 | ..... | E04D 13/06 |
| JP | 02058664 | A * | 2/1990 | ..... | E04D 13/06 |
| WO | WO 99/31332 | | 6/1999 | | |
| WO | WO 2007/108801 | | 9/2007 | | |

OTHER PUBLICATIONS

Machine Translation of Austrian Patent AT 327651B.

Office Action dated May 24, 2012 for U.S. Appl. No. 13/091,580.

European Search Report dated Oct. 10, 2012 for Application No. EP 12179930.

* cited by examiner

ROOF GUTTER COVER WITH VARIABLE APERTURE SIZE

BACKGROUND

In the past, typical gutter covers have been formed with a substantially imperforate upper surface or top portion and with a relatively deep, water-channeling trough located near the area where the gutter cover is attached to the front lip of the gutter. This arrangement was believed to provide the most durability, leaf-shedding ability and pleasing appearance. However, the imperforate top, deep trough gutter cover was somewhat limited in its versatility. Likewise, the water-channeling trough tended to require a relatively elevated front wall that, in turn, occasionally resulted in difficulty mounting the rear portion of the gutter cover on the roof structure without changing the position of the gutter. As a result of these limitations, installing these conventional gutter covers could be relatively laborious or even impossible in the case of older structures such as half-round or box-style gutters.

BRIEF SUMMARY

A gutter cover for a roof gutter is fashioned to extend longitudinally in overlying relation to a length of the gutter. The gutter cover comprises: (i) a top portion extending forwardly from a rear edge of the gutter cover; (ii) a front wall extending downwardly from the top portion; (iii) a ledge extending generally horizontally in front of the front wall; (iv) a first longitudinally extending ridge formed in the top portion, (v) a first bank of apertures behind the first longitudinally extending ridge, and (vi) a second bank of apertures in front of the first longitudinally extending ridge; wherein the average size of the apertures in the first bank is larger than the average size of the apertures in the second bank.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

Figure 1:
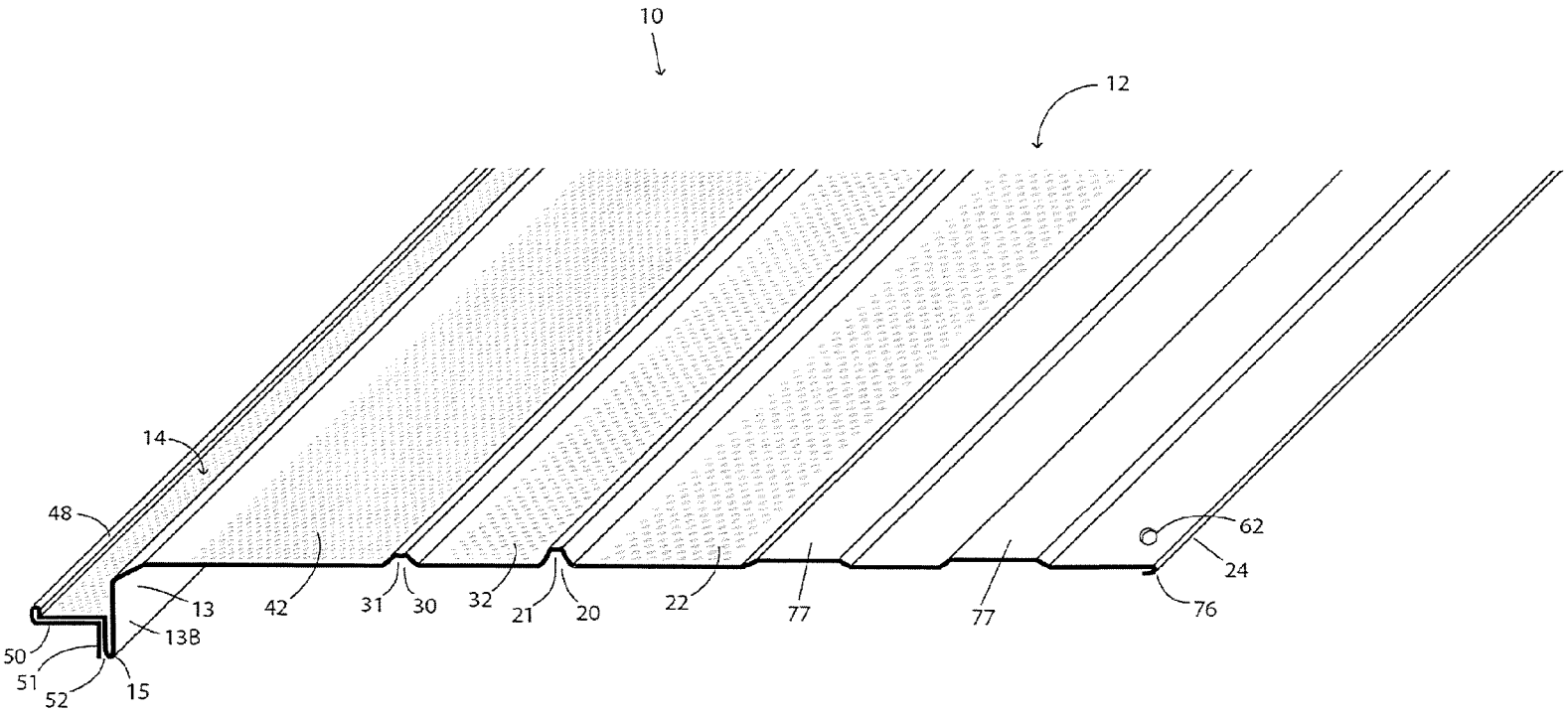
FIG. 1 is a perspective view of an embodiment of the gutter cover.

As shown in FIG. 1, a gutter cover (10) is designed to fit over a gutter to prevent debris from entering the gutter while allowing water to freely flow into the gutter. The gutter extends longitudinally, generally overlying the length of the gutter. The gutter cover comprises: (i) a top portion (12) that extends forwardly from a rear edge (24) of the gutter cover; (ii) a front wall (13) that extends downwardly from the top portion (12); (iii) a ledge (14) that extends generally horizontally in front of the front wall (13); (iv) a first longitudinally extending ridge (20) formed in the top portion, (v) a first bank of apertures (22) behind the first longitudinally extending ridge (20), and (vi) a second bank of apertures (32) in front of the first longitudinally extending ridge (20); wherein the average size of the apertures in the first bank (22) is larger than the average size of the apertures in the second bank (32).

In one embodiment the gutter cover may have more than one longitudinally extending ridge. The second longitudinally extending ridge (30) is in front of the first longitudinally extending ridge (20). In another embodiment the gutter cover has at least three longitudinally extending ridges. The third longitudinally extending ridge (40) is in front of the second longitudinally extending ridge (30).

The longitudinally extending ridge or ridges provide rigidity to the gutter cover. In one embodiment a longitudinally extending ridge (20, 30) has a continuing depression (21, 31) at the top which is believed to provide additional rigidity. Rigidity is important because the gutter cover is a long material which may buckle when being handled, moved, or installed. In one embodiment all the longitudinally extending ridges (20, 30) have a continuing depression (21, 31) at the top of the ridge. In another embodiment, not all of the ridges have a continuing depression at the top of the ridge.

In one embodiment the ridges may be of different heights. The ridges are believed to help slow down the water as it travels over the gutter cover. If the water is traveling too fast it may pass over the gutter cover without entering the gutter. A larger ridge will slow down the water more than a smaller ridge. In one embodiment, each ridge that is closer to the rear is larger than each ridge that is closer to the front. In one embodiment, the first longitudinally extending ridge may be about 0.635 cm (0.25 in) tall, the second longitudinally extending ridge may be about 0.44 cm (0.175 in) tall, and the third longitudinally extending ridge may be about 0.32 cm (0.125 in) tall. In one embodiment In one embodiment there is more than one bank of apertures (such as 22 and 32). A bank of apertures is the apertures that are grouped together between ridges (such as 30 and 30) or between a ridge (20) and the rear edge (24) of the gutter or the front wall (13). The gutter cover between ridges is not required to have a bank of apertures. In one embodiment, the average size of the apertures in successive banks is smaller as the banks are closer to the front. A larger aperture on the gutter cover is believed to allow more water to enter the gutter, but it also has the potential to allow more debris into the gutter. A smaller aperture on the gutter cover is believed to allow less water to enter the gutter, but it blocks more debris from entering the gutter.

In one embodiment the gutter cover comprises at least three banks of apertures. In this embodiment, the first bank of apertures (22) is behind the first longitudinally extending ridge (20) and the second bank of apertures (32) is in front of the first longitudinally extending ridge (20) and behind the second longitudinally extending ridge (30), the third bank of apertures (42) is in front of the second longitudinally extending ridge (30).

In one embodiment the gutter cover comprises at least four banks of apertures. In this embodiment, the first bank of apertures (22) is behind the first longitudinally extending ridge (20), and the second bank of apertures (32) is in front of the first longitudinally extending ridge (20) and behind the second longitudinally extending ridge (30), the third bank of apertures (42) is in front of the second longitudinally extending ridge (30) and behind the third longitudinally extending ridge (40), the fourth bank of apertures (52) is in front of the third longitudinally extending ridge (40).

In one embodiment the first bank of apertures may have an average diameter of 0.24 cm (0.096 in). The second bank of apertures may have an average diameter of 0.19 cm (0.075 in). If present, the third bank of apertures may have an average diameter of 0.15 cm (0.60 in). If present, the fourth bank of apertures may have an average diameter of 0.11 cm (0.045 in).

The apertures may be laid out in any configuration; they may be in a zigzag row or in straight lines. The apertures may be are sized to keep out debris.

The top portion (12) may have a longitudinally extending, imperforate rear section which extends forwardly from the rear edge (24) so that it may extend under the shingles (28), approximately 7.6-10.2 cm. (3-4 in.). The rear section may be bendable so it can be mounted on the fascia (32) behind the gutter, or under any of the first several rows of shingles (28).

In one embodiment there are holes (62) near the rear edge (24) of the gutter cover (10). These holes (62) provide an opening for a fastener to attach the gutter cover to the roof under the shingles (28) or to the fascia (32). Any fasteners used in the industry will work, include screws and nails. In one embodiment the holes (62) are located within 1 inch of the rear edge (24) of the gutter cover (10) and spaced apart by about 1 foot. The location of the holes will make it easer for the installer to attach the gutter cover to the roof at the proper location with the correct number of fasteners per length of gutter cover. The holes may be sized to accept fasteners, about 0.32 cm (0.125 in) in diameter.

In one embodiment the gutter cover has apertures in the ledge (14). These apertures allow water that has flowed over the top of the gutter cover to still pass into the gutter. These apertures may be larger or smaller than the apertures on the top of the gutter cover.

In another embodiment the horizontal ledge (14) has a plurality of apertures and an upturned lip or weir (48) to keep rainwater from dripping off of the ledge. A return gutter lip-mounting surface (50) extends rearward from the weir (48) a distance slightly greater than the width of the gutter lip and terminates in a downwardly curved, gutter lip-engaging end flange (51). A space (52) is advantageously provided between the ledge (14) and the gutter lip-mounting surface (50) through which rainwater reaches the gutter. The ledge (14) may be secured to the gutter lip by zip screws or other fasteners known in the art. Additional gutter covers are installed in substantially the same manner to completely cover the gutter.

In one embodiment the front wall (13) includes a curved nose or inclined ramp extending forwardly and downwardly from the front section of the top portion (12). A lower section (13B) of the front wall (13) may include a splashguard (15) extending downwardly and inwardly a distance within a range of 0.8-1.5 cm. (0.3-0.6 in.), and then upwardly and outwardly into the generally horizontal ledge (14). In one embodiment the lower section (13B) of the front wall (13) includes a splashguard (15) extending downwardly a distance within a range of 0.8-1.5 cm. (0.3-0.6 in.), and then upwardly and outwardly into the generally horizontal ledge (14). In one embodiment the splashguard (15) has several openings through which rainwater drains into the gutter. In another embodiment openings are located on the front wall (13) to allow rainwater to drain into the gutter.

In one embodiment the front wall (13) is relatively short so that the vertical distance from top of the front wall (13) to the ledge (14) is less than 2.54 cm (1.0 in) or 1.27 cm (0.5 in). It is believed that by keeping the distance relatively small, the versatility of the present gutter cover (10) is enhanced, both in terms of its adaptability to gutters of various shapes and sizes and in terms of its ability to be mounted at various heights and locations to accommodate the existing gutter structure. In addition, the low profile appearance created by keeping the distance relatively small is believed to add aesthetic appeal to the present gutter cover (10) once installed.

In one embodiment there is a lowered flat section (75) or a raised flat section (77) behind the first bank of apertures (22), or both. The lowered or raised flat section will have two bends on each side so that the section is generally parallel to the top of the gutter cover. These bends provide additional rigidity to the gutter cover. Depending on the width of the gutter some or all of the lowered flat sections (75) or raised flat sections (77) may be installed under the shingles (28). The lowered flat section (75) or raised flat section (77) also helps to slow down rain water passing over it. The rain water will have to travel down into the lowered flat section then back up out of it, or over the raised flat section (77). In addition the lowered flat section (75) or raised flat section (77) may cause turbulence in the water to slow it down. In another embodiment, there may be more than one lowered or raised flat sections.

The rear edge (24) of the top portion (12) may be turned under or hemmed (76). The rear edge corners may be clipped. Clipping the corner means that the corner is cut off so that the sharp corner is less likely to cut the installer or damage shingles (28) during installation. In this manner, the chances of installers being cut by the rear edge (24) or corners is reduced, and the chances of the rear edge (24) or corners getting caught or causing damage as they are inserted under roof shingles (28) is reduced.

Figure 3:
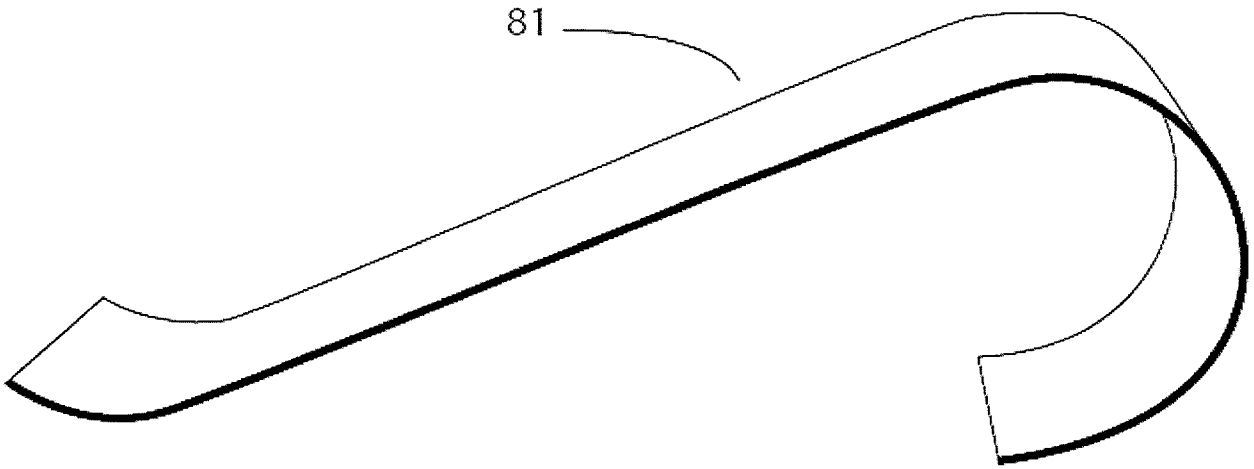
FIG. 3 is a side view of an embodiment of a spring clip to be used to secure the gutter cover to the lip of the gutter.

In one embodiment the gutter cover (10) has openings (64) to allow a spring clip (81) (shown in FIG. 3) to be used to secure the gutter cover (10) to the lip of the gutter (19). The opening (64) allows the spring clip (81) to pass through the gutter. The opening (64) for the spring clip may be located on the front wall (13). The openings may be about 0.5 inches in width and about 0.075 to about 0.125 inches in height. These openings may be periodically spaced apart along the length of the gutter cover. In one embodiment the distance between the openings may be about 12 inches. The opening may be equal in elevation with the weirs on the ledge to allow the spring clip to go over the weirs.

Figure 2:
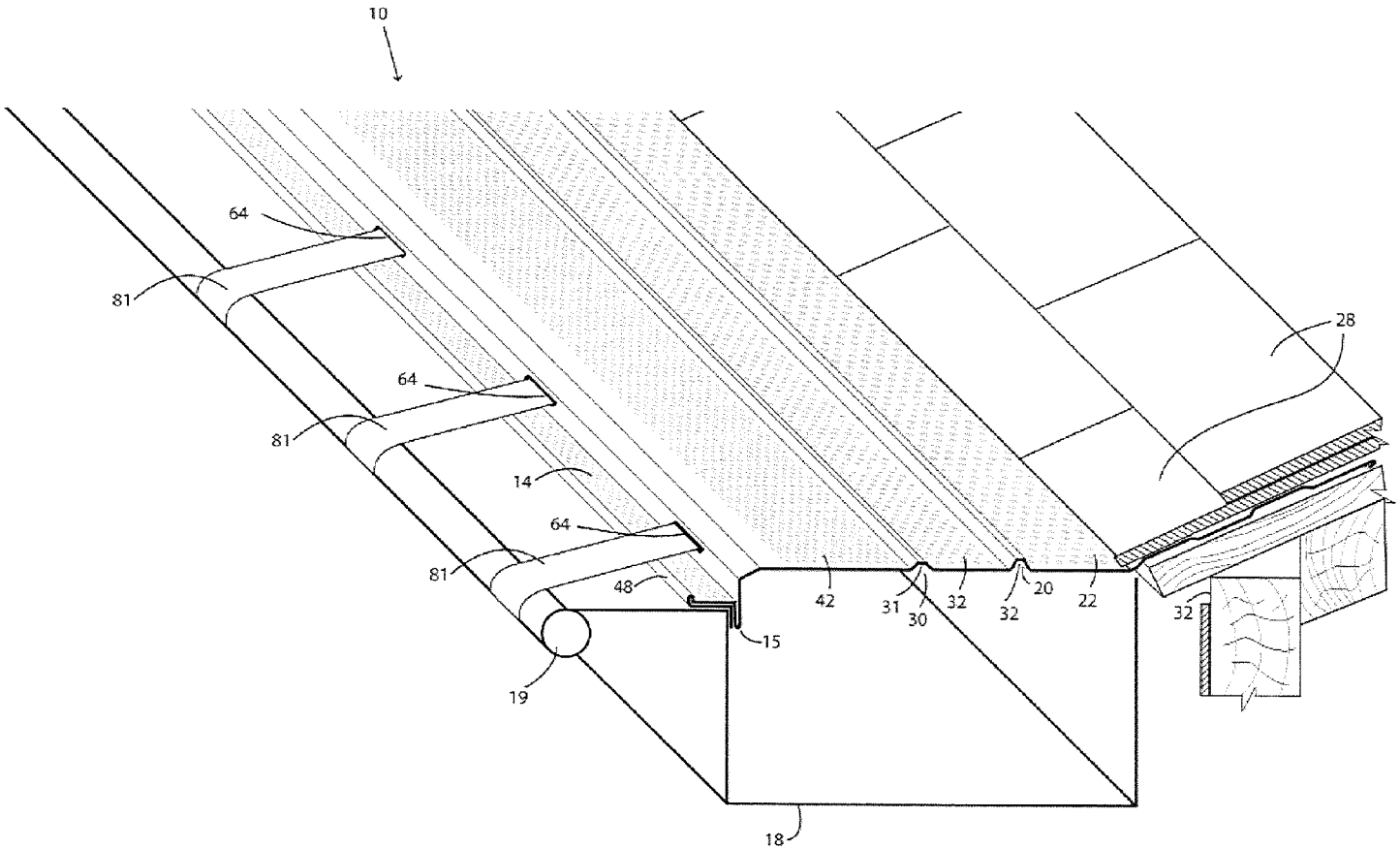
FIG. 2 is a perspective view of an embodiment of the gutter cover installed on a gutter.

As shown in FIG. 2, the gutter cover (10) is installed on a gutter (18) using a spring clip (81) to secure the gutter cover (10) to the lip of the gutter (19). The gutter cover (10) is bent so that the rear part of the gutter cover goes under the shingles (28) while the front section of the top portion (12) is horizontal.

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A gutter cover for a roof gutter comprising:

(i) a top portion extending forwardly from a rear edge of the gutter cover, wherein the top portion is substantially planar;

(ii) a front wall extending downwardly from the top portion;

(iii) a ledge extending generally horizontally in front of the front wall;

(iv) a first longitudinally extending ridge formed in the top portion, (v) a first bank of apertures behind the first longitudinally extending ridge, and (vi) a second bank of apertures in front of the first longitudinally extending ridge;

wherein the average size of the apertures in the first bank is larger than the average size of the apertures in the second bank;

at least a second longitudinally extending ridge in front of the first longitudinally extending ridge; wherein at least one ridge that is closer to the rear is higher, as measured from the top portion, than each ridge that is closer to the front.

2. The gutter cover of claim 1, wherein each of the longitudinally extending ridges have a continuing depression at the top of the ridge.

3. The gutter cover of claim 1, wherein the gutter cover comprises at least three banks of apertures; the second bank of apertures is in front of the first longitudinally extending ridge and behind the second longitudinally extending ridge, the third bank of apertures is in front of the second longitudinally extending ridge.

4. The gutter cover of claim 3, wherein the wherein the average size of the apertures in a bank that is closer to the rear is larger than the average size of the apertures in a bank that is closer to the front.

5. The gutter cover of claim 1, wherein the gutter cover comprises at least a third longitudinally extending ridge in front of the second longitudinally extending ridge.

6. The gutter cover of claim 5, wherein the gutter cover comprises at least four banks of apertures; the second bank of apertures is in front of the first longitudinally extending ridge and behind the second longitudinally extending ridge, the third bank of apertures is in front of the second longitudinally extending ridge and behind the third longitudinally extending ridge, the fourth bank of apertures is in front of the third longitudinally extending ridge.

7. The gutter cover of claim 1, wherein there are holes in the gutter cover near the rear edge of the gutter cover.

8. The gutter cover of claim 1, wherein there are apertures in the ledge.

9. The gutter cover of claim 1, wherein there is a lowered flat section behind the first bank of apertures.

10. The gutter cover of claim 1, wherein there are openings sized to receive spring clips to secure the gutter cover to a gutter.

11. The gutter cover of claim 10, wherein the openings are located on the front wall.

* * * * *